US007676926B2

(12) United States Patent
Langenwalter

(10) Patent No.: US 7,676,926 B2
(45) Date of Patent: Mar. 16, 2010

(54) DECORATIVE FENCING SYSTEM

(75) Inventor: Duane Langenwalter, Monroe, CT (US)

(73) Assignee: Garden Zone, LLC, North Charleston, SC (US)

( * ) Notice: Subject to any disclaimer, the term of this patent is extended or adjusted under 35 U.S.C. 154(b) by 686 days.

(21) Appl. No.: 11/654,562

(22) Filed: Jan. 18, 2007

(65) Prior Publication Data

US 2007/0272910 A1 Nov. 29, 2007

Related U.S. Application Data

(62) Division of application No. 10/797,410, filed on Mar. 10, 2004.

(51) Int. Cl.
*B21D 47/00* (2006.01)

(52) U.S. Cl. ..... 29/897.31; 29/897.32

(58) Field of Classification Search ..... 256/21, 256/22, 24, 25, 26; 47/33; 29/897.31, 897.32, 29/897.312

See application file for complete search history.

(56) References Cited

U.S. PATENT DOCUMENTS

| | | | |
|---|---|---|---|
| RE807 | E | 9/1859 | Jenkins |
| D6,411 | S | 2/1873 | Healey |
| D9,274 | S | 5/1876 | Ricker |
| 207,518 | A | 8/1878 | Hayden |
| 284,687 | A | 9/1883 | Tunica |
| 336,405 | A | 2/1886 | Ginther |
| 415,382 | A | 11/1889 | Darnell |
| 563,042 | A | 6/1896 | Le Flamboy |
| 803,741 | A | 11/1905 | Carlson |
| 1,331,117 | A | 2/1920 | Miller |
| 1,426,215 | A | 8/1922 | Revert |
| 2,074,688 | A | 3/1937 | Friend |
| 2,484,413 | A | 10/1949 | Kouril, Jr. |
| 2,581,318 | A | 1/1952 | Bartlett |
| 2,622,848 | A | 12/1952 | Campbell |
| 2,651,502 | A | 9/1953 | Carvelo et al. |
| 2,709,073 | A | 5/1955 | Dougherty |
| 3,484,081 | A | 12/1969 | Rowan |
| 5,301,926 | A | 4/1994 | Sharp |
| 6,811,145 | B2 | 11/2004 | Gibbs et al. |
| 2003/0155565 | A1 | 8/2003 | Cantley |

*Primary Examiner*—Michael P Ferguson
(74) *Attorney, Agent, or Firm*—Finnegan, Henderson, Farabow, Garrett & Dunner, LLP

(57) ABSTRACT

A decorative fencing system is provided for use as a small fence or decorative accent for a yard. The fencing system comprises several different structural components that may be joined in various combinations so as to create a limitless number of different configurations or arrangements. The components include base units, decorative end units and gate units, each of which may be attached to the other components in any combination thereof. Each of these components are attached to post sections which are inserted through post rings or post hinges on the individual components to thereby allow for each component to be rotated to the desired position relative to the post section. The post sections are secured to the ground by means of stakes that are first driven into the ground and the post section is then inserted into a sleeve in the stake to thereby provide support and stability for the fencing system. A separate and smaller pin is provided on the end units to anchor these components to the ground.

6 Claims, 3 Drawing Sheets

DECORATIVE FENCING SYSTEM

This is a division of application Ser. No. 10/797,410, filed Mar. 10, 2004, which is incorporated herein by reference.

BACKGROUND OF THE INVENTION

1. Field of the Invention

The present invention relates generally to a decorative fencing system, and, more particularly, to such a decorative fencing system that includes multiple components and may be arranged in a potentially infinite number of combinations and permutations so as to be used as a small or low fence, or a decorative accent for a yard or walk, or even a combination thereof.

2. Description of the Prior Art

The prior art fails to specifically address either the problem or the solution arrived upon by applicant. Decorative fencing systems have long been known in the industry, as has the use of sectional fence structures to create various configurations for fencing systems. Some examples of such fencing systems are shown in patents that date back to the mid to late 1800s, such as, for example, U.S. Pat. No. 807 to Jenkins for "Iron Fence" in 1859; U.S. Pat. No. 6,411 to Healey for "Fences" in 1873; U.S. Pat. No. 9,274 to Ricker for "Fence" in 1876; U.S. Pat. No. 207,518 to Hayden for "Fence" in 1878; U.S. Pat. No. 284,687 to Tunica for "Girder Picket Fence" in 1883; U.S. Pat. No. 336,405 to Ginther for "Fence" in 1886; U.S. Pat. No. 415,382 to Darnell for "Fence" in 1889; and U.S. Pat. No. 563,042 to Le Flamboy for "Fence" in 1896.

Similar devices are also disclosed in U.S. Pat. Nos. 1,331,117; 1,426,215; 2,074,688; 2,484,413; 2,651,502; 2,709,073. Another such device is disclosed in a recently filed U.S. application Pub No. US 2003/0155565 A1 for "Plastic Fencing Simulative of Wrought Iron."

As will be appreciated, none of these prior patents even address the problem faced by applicant let alone offer the solution proposed herein.

SUMMARY OF THE INVENTION

Against the foregoing background, it is a primary object of the present invention to provide a decorative fencing system having several components that may be arranged in a limitless number of configurations or combinations.

It is another object of the present invention to provide such a decorative fencing system that may be used as a small or low fence, or a decorative accent for a yard or walk, or even a combination thereof.

It is still another object of the present invention to provide such a decorative fencing system that allows a user to purchase and use only those elements necessary to create the design or shape of her choosing.

It is another object of the present invention to provide such a decorative fencing system that is easy to assemble and disassemble.

It is but another object of the present invention to provide such a decorative fencing system that may be either permanently or temporarily affixed to the ground.

It is another object of the present invention to provide such a decorative fencing system which includes all the elements necessary to create a standard fence, including base units, gates and end units.

It is yet still another object of the present invention to provide such a decorative fencing system which may include a variety of interchangeable decorative elements.

It is but another object of the present invention to provide such a decorative fencing system in which the individual components are manufactured from a variety of materials or be provided with a variety of finishes.

To the accomplishments of the foregoing objects and advantages, the present invention, in brief summary, comprises a decorative fencing system designed to be used as a small fence or decorative accent for a yard, or combination thereof. The fencing system includes several different components that may be joined in various combinations so as to create a limitless number of different configurations or arrangements. The components include base units, decorative end units and gate units, each of which may be attached to the other components in any combination thereof. Each of these components are attached to post sections which are inserted through post rings or post hinges on the individual components to thereby allow for each component to be rotated to the desired position relative to the post section. The post sections are secured to the ground by means of stakes that are first driven into the ground and the post section is then inserted into a sleeve in the stake to thereby provide support and stability for the fencing system. A separate and smaller pin is provided on the end units to anchor these components to the ground.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

DETAILED DESCRIPTION OF THE INVENTION

Figure 1:
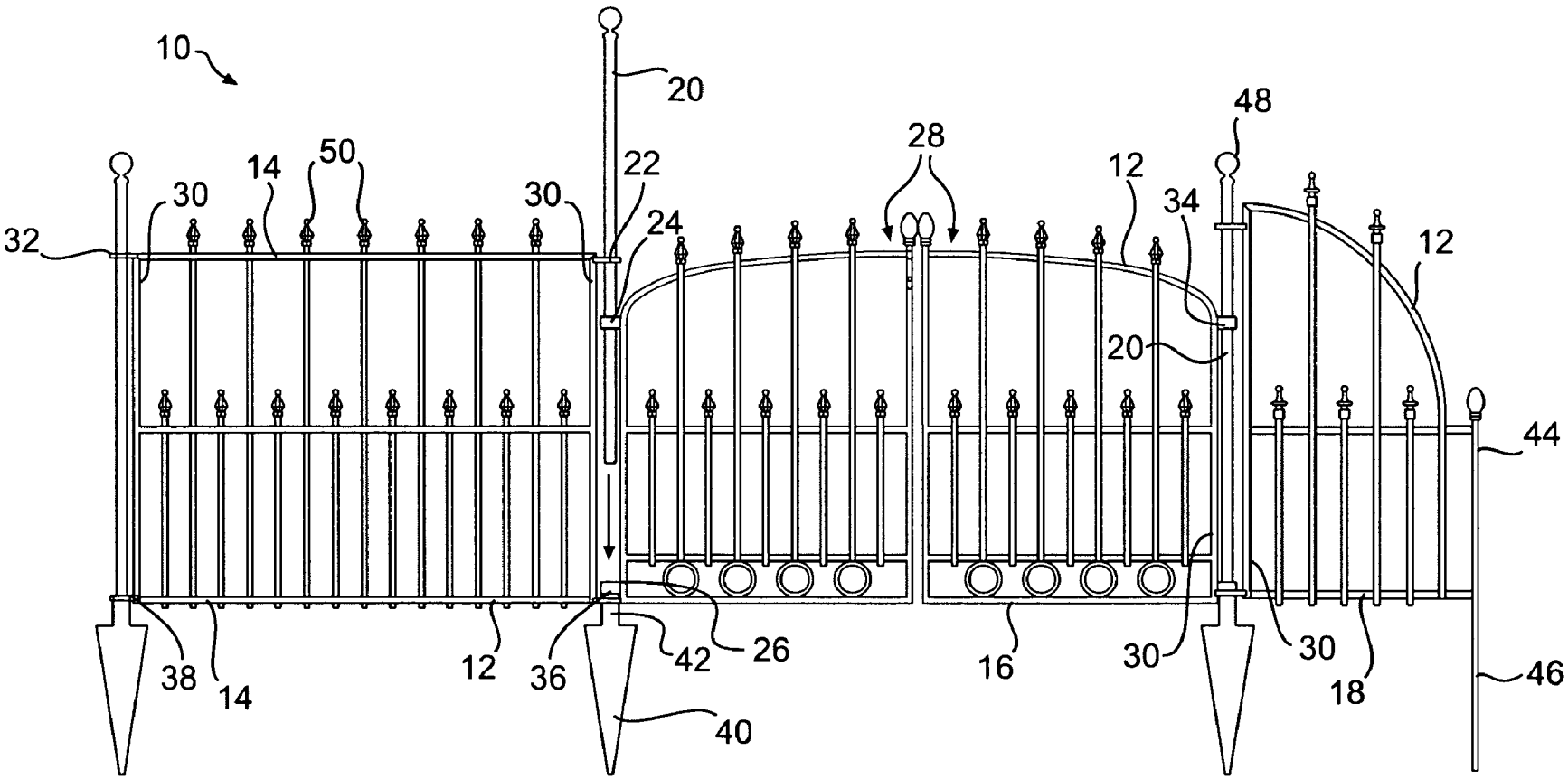
FIG. 1 is a front elevational view of the decorative fencing system of the present invention showing the various components thereof.
Figure 2:
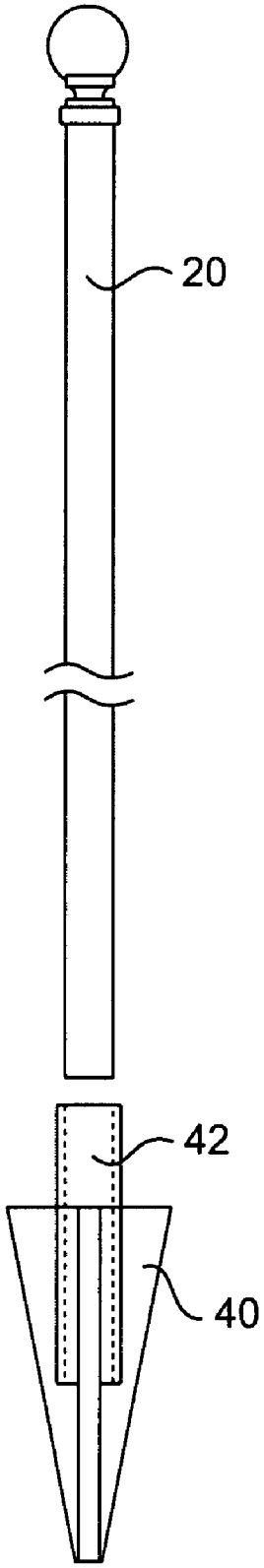
FIG. 2 is an exploded front elevational view of the post and stake of the decorative fencing system of the present invention.

Referring to the drawings and, in particular, to FIGS. 1 and 2 thereof, the decorative fencing system of the present invention, referred to generally by reference numeral 10, is illustrated. The fencing system 10 comprises separate structural components 12 including a base unit 14, gate unit 16 and end unit 18, which are arranged and combined with each other so as to create a potentially limitless number of configurations for the decorative fencing system 10.

The structural components 12 are attached to each other by means of one or more posts 20 to which the structural components 12 may be affixed. In the preferred embodiment, the means for attaching the structural components 12 comprises post rings 22, which are disposed on either end of the base units 14 or on one end of the end unit 18, or by post hinges 24, which are disposed on the outside edges of the gate units 16. The post rings 22 are essentially annular elements having an inner diameter slightly larger than the diameter or width of the posts 20 such that post 20 may be slidably inserted within the post rings 22 to thereby engage either the base unit 14 or end unit 18. Similarly the post hinges 24 including the same annular element similar to the post rings 22, coupled with a hinge 26 that allows the individual gate elements 28 of the gate unit 16 to swing open and shut. In the preferred embodiment the gate elements 28 comprise a pair of complementary doors that may be operated independently or concurrently, although other designs are possible so as to fit with the design and theme of the decorative fencing system 10.

As illustrated in FIG. 1, each of the structural components 12 includes two post rings 22 or post hinges 24 at each end at which the component 12 may be attached to the post 20—for example, the base unit 14 includes two post rings 22 on either side thereof, the gate unit 16 includes two post hinges 24 on the outside edge of each gate element 28, and the end unit 18 includes two post rings 22 on one side thereof. In the preferred embodiment, the post rings 22 or post hinges 24 are attached to a substantially vertical element 30 so that the post rings 22 or post hinges 24 are in alignment when receiving the posts 20. Of course, alternate embodiments are contemplated in which either the post rings 22 or post hinges 24 are attached to horizontal components or other elements provided, however, that the post rings 22 or post hinges 24 are in alignment. Furthermore, while in the preferred embodiment only two post rings 22 or post hinges 24 are disposed along each vertical element 30, more may be provided so as to further strengthen and secure the attachment of the structural components 12 to the posts 20.

It should also be appreciated that while in the preferred embodiment, the post rings 22 and post hinges 24 are disposed at the top and the bottom of the vertical elements 30, as shown in FIG. 1, they may be positioned at various heights along the length of the vertical elements 30 as may be desired. For example, as illustrated in FIG. 1, the height of the upper post ring 32 on the base unit 14 is higher than that of the upper post ring 32 on the end unit 18, which, in turn, is higher than upper post hinge 34 on the gate unit 16. This configuration facilitates the combination of two or more structural components 12 since the post rings 22 or post hinges 24 will not necessarily interfere with each other. It should also be appreciated that in the preferred embodiment, contact should be avoided between the post hinges 24 and the post rings 22 so as to prevent interference with the operation of the hinges 26. Toward that end, it may be preferred to mount the lower post hinges 36 of the gate unit 16 above the lower post rings 38 of either the base unit 14 or end unit 18.

The decorative fencing system 10 is secured to the ground by means of one or more stakes 40. The stakes 40 are designed to be driven into the ground and receive the posts 20 to thereby support the structural components 12 in place. In the preferred embodiment, the stakes 40 are wedge shaped or include a plurality of fins so as to facilitate their insertion into the ground, although a variety of alternative designs are possible. For example, the shape of the stakes 40 is designed with the idea that the stakes would be forcibly driven into the ground. However, if the user were to dig a hole for the stakes 40, these elements could be of practically any shape or size, provided they could receive and retain the posts 20.

In the preferred embodiment, the stakes 40 receive and retain the posts 20 by means of a stake sleeve 42, essentially a cylindrical recess or cavity within the body of the stake 40 having an internal diameter slightly larger than the diameter or width of the post 20 such that the post 20 will be received within and retained by the stake sleeve 42 by means of frictional contact therebetween.

Ideally, the stake sleeve 42 should be of sufficient length so as to securely receive the post 20, and the length of the portion of the stake 40 that is inserted into the ground should be sufficient to prevent the post 20 from toppling over when the decorative fencing system 10 is assembled. In the preferred embodiment, the length of the portion of the stake 40 that is inserted into the ground is approximately 10 inches, although longer stakes 40 would function just as well, and shorter ones may also serve effectively provided the weight of the structural components and posts 20 are not to great, and the ground itself is firm enough to retain the stake 40 therein. Also in the preferred embodiment, the stake sleeve 42 should extend about the ground level by a sufficient height to allow the desired clearance between the bottom of the structural components 12 and the ground. This is of particular importance for the gate unit 16, since the gate elements 28 must clear any uneven ground so as to allow the elements to open and close properly. Furthermore, the combined weight of the post 20 and any structural components 12 attached thereto serve to force the post 20 within the stake sleeve 42 and prevent the post from sliding out.

The end units 18 serve to provide decorative termination points for the decorative fencing system 10, and as such, include a decorative termination point 44 on the side opposite the vertical element 30 or the side to which the post rings 22 are attached. Rather than use a separate post 20 to anchor the termination point 44 to the ground, a separate stake pin 46 is provided at the termination point 44, which stake pin 46 extends below ground level when the end unit 18 is attached, thereby securing the end of the end unit 18 to the ground. As illustrated in FIG. 1, in the preferred embodiment the stake pin 46 is long and thin to facilitate its insertion into the ground. It is also of approximately the same length as the stake 40, although a shorter stake pin 46 would work just as effectively.

In the preferred embodiment, the components of the decorative fencing system 10 are manufactured from tubular steel, both square and round stock. A powder coat finish may be provided on some or all of the elements. For example, a separate color or finish or a different material, such as bronze colored cast iron, may be used for decorative accents 48 such as finals 50 or decorative ball caps 52. All the steel components are ideally welded in assembly, and the decorative accents 48 may be held in place by force fit, adhesive, welding, some combination thereof or other means known in the art.

Alternative manufacturing variations are also contemplated, including manufacturing individual components out of solid iron or steel pieces, welding and finishing by powder coating or painting. The components may be produced as individual cast iron pieces and finished with various paint techniques to create different appearances.

It should be appreciated that the design of the individual structural components shown in the Figures is just one possible design for the decorative fencing system 10 of the present invention. A variety of different designs and decorative accents 48 are contemplated, such as a Victorian design or a more modern design. The only limitation is that the design of the system 10 must be embodied by the structural components 12 and tied together by the posts 20, post rings 22 and post hinges 24.

Figure 3:
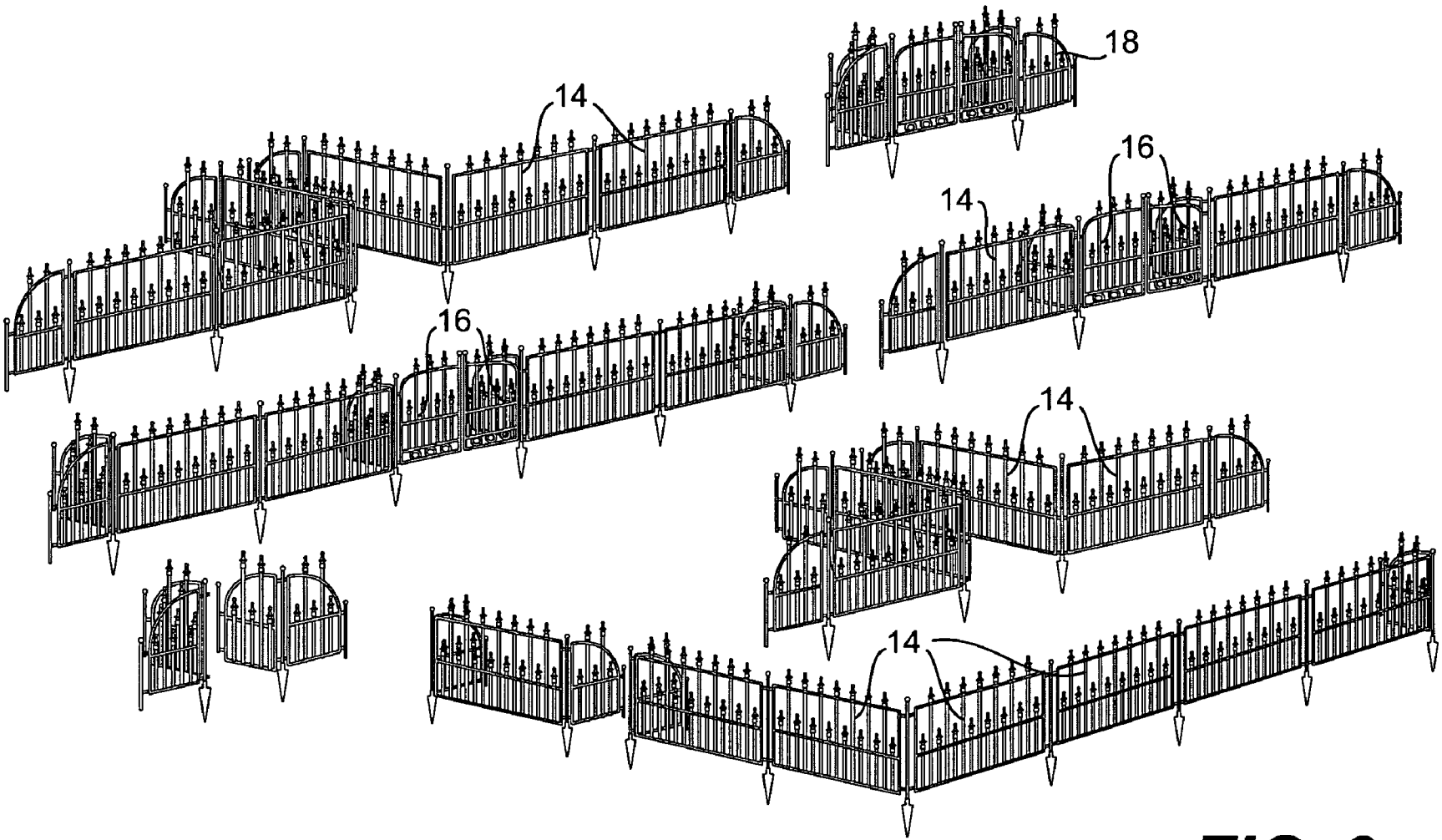
FIG. 3 are perspective views illustrating some of the various configurations of the decorative fencing system of the present invention.

The process of assembling the fencing system 10 is designed to be simple and easy to alter. In the preferred embodiment, a stake 40 is driven into the ground, and the individual structural components 12 are held into place above the stake 40. A post 20 is inserted through the post rings 22 and/or post hinges 24, then inserted into the stake sleeve 42 of the stake 40. The process is repeated as necessary until the desired configuration is achieved, allowing for a potentially infinite number of combinations and angles between the structural components. Some examples of these variations are illustrated in FIG. 3. Since each of the structural components 12 may be purchased separately, the decorative fencing system 10 may be as large or as small as the user, such as a homeowner or landscaper, desires.

Having thus described the invention with particular reference to the preferred forms thereof, it will be obvious that various changes and modifications can be made therein without departing from the spirit and scope of the present invention as defined by the appended claims.

Wherefore, I claim:

1. A method for assembling a customizable decorative fencing system, said method comprising the steps of:

providing a decorative fencing system comprising:

a plurality of stakes configured to be driven into the ground, each said stake including a hollow stake sleeve having an internal diameter;

a plurality of posts, each said post having a first diameter being smaller than the internal diameter of each said hollow stake sleeve, any one of said posts slidably, interchangeably inserting into and being frictionally and removably retained by said stake sleeve of any one of said stakes; and a plurality of structural fencing components, each said fencing component including a vertical element disposed at least one side edge thereof and a pair of post attachment collars, one of said post attachment collars disposed at the top of said vertical element and the other said post attachment collar disposed at the bottom of said vertical element, said post attachment collars each having an annular opening therethrough with a second diameter larger than said first diameter of said post, said fencing components slidably, rotatably, removably and interchangeably attaching to said posts to thereby connect adjacent structural fencing components to each other via one of said posts while allowing said adjacent structural fencing components to be rotationally adjusted relative to said one post;

driving said stakes at a plurality of selected locations into the ground;

positioning each said pair of post attachment collars of said fencing components over a respective selected one of said stakes such that said openings of each said pair of post attachment collars of said fencing components are axially aligned with said respective selected one of said stakes; and inserting one of said posts downwardly through each said aligned pair of post attachment collars into said stake sleeve of said respective selected one of said stakes so as to be removably, frictionally engaged thereby;

said structural fencing components being chosen from the group consisting of interchangeable base units, interchangeable gate units and interchangeable end units.

2. The method of claim 1, further comprising the step of customizing and adjusting said fencing system by:

removing one or more of said posts from one or more said structural fencing components and one or more corresponding said stakes;

repositioning said one or more structural fencing components over said corresponding one or more said stakes; and reinserting said one or more posts through respective said post attachment collars of said one or more said structural fencing components and into said corresponding one or more stakes.

3. The method of claim 2, wherein said step of customizing and adjusting said fencing system further comprises the steps of:

after removing said one or more of said posts from said one or more said structural fencing components and said corresponding one or more stakes, and prior to repositioning said one or more structural fencing components over said corresponding one or more said stakes, removing said one or more of said stakes from the ground;

moving said one or more of said stakes to a different location; and reinserting said one or more of said stakes into the ground at said different location.

4. A method for assembling a customizable decorative fencing system, said method comprising the steps of:

providing a decorative fencing system comprising:

a plurality of stakes configured to be driven into the ground, each said stake including a hollow stake sleeve having an internal diameter;

a plurality of posts, each said post having a first diameter being smaller than the internal diameter of each said hollow stake sleeve, any one of said posts slidably, interchangeably inserting into and being frictionally and removably retained by said stake sleeve of any one of said stakes; and a plurality of structural fencing components, each said fencing component including a vertical element disposed at least one side edge thereof and a pair of post attachment collars, one of said post attachment collars disposed at the top of said vertical element and the other said post attachment collar disposed at the bottom of said vertical element, said post attachment collars each having an annular opening therethrough with a second diameter larger than said first diameter of said post, said fencing components slidably, rotatably, removably and interchangeably attaching to said posts to thereby connect adjacent structural fencing components to each other via one of said posts while allowing said adjacent structural fencing components to be rotationally adjusted relative to said one post;

said structural fencing components being chosen from the group consisting of interchangeable base units, interchangeable gate units and interchangeable end units;

driving a first said stake at a selected location into the ground;

positioning a first said pair of post attachment collars of a first said fencing component over said first stake such that said openings of said first pair of post attachment collars of said first fencing component are axially aligned with said first stake;

inserting a first said post downwardly through said aligned first pair of post attachment collars of said first fencing component into said stake sleeve of said first stake so as to be removably, frictionally engaged thereby;

driving a second said stake at a selected location into the ground;

positioning a second said pair of post attachment collars of a second said fencing component over said second stake such that said openings of said second pair of post attachment collars of said second fencing component are axially aligned with said second stake; and inserting a second said post downwardly through said aligned second pair of post attachment collars of said second fencing component into said stake sleeve of said second stake so as to be removably, frictionally engaged thereby.

5. The method of claim 4, further comprising the step of customizing and adjusting said fencing system by:

removing one or more of said posts from one or more said structural fencing components and one or more corresponding said stakes;

repositioning said one or more structural fencing components over said corresponding one or more said stakes; and reinserting said one or more posts through respective said post attachment collars of said one or more said structural fencing components and into said corresponding one or more stakes.

6. The method of claim 5, wherein said step of customizing and adjusting said fencing system further comprises the steps of:

after removing said one or more of said posts from said one or more said structural fencing components and said corresponding one or more stakes, and prior to repositioning said one or more structural fencing components over said corresponding one or more said stakes, removing said one or more of said stakes from the ground;

moving said one or more of said stakes to a different location; and reinserting said one or more of said stakes into the ground at said different location.

* * * * *

UNITED STATES PATENT AND TRADEMARK OFFICE

CERTIFICATE OF CORRECTION

PATENT NO. : 7,676,926 B2
APPLICATION NO. : 11/654562
DATED : March 16, 2010
INVENTOR(S) : Duane Langenwalter It is certified that error appears in the above-identified patent and that said Letters Patent is hereby corrected as shown below:

Claim 1, col. 5, lines 20-21, "disposed at least one" should read --disposed at at least one--.

Claim 4, col. 6, lines 20-21, "disposed at least one" should read --disposed at at least one--.

Signed and Sealed this

Twentieth Day of July, 2010

David J. Kappos

David J. Kappos
*Director of the United States Patent and Trademark Office*